US008313261B1

(12) United States Patent
Mah

(10) Patent No.: US 8,313,261 B1
(45) Date of Patent: Nov. 20, 2012

(54) NAIL POLISH BOTTLE DEVICE

(76) Inventor: Connie Mah, Portland, OR (US)

( * ) Notice: Subject to any disclaimer, the term of this patent is extended or adjusted under 35 U.S.C. 154(b) by 23 days.

(21) Appl. No.: 12/189,614

(22) Filed: Aug. 11, 2008

(51) Int. Cl.
*A46B 11/00* (2006.01)
*A46B 17/02* (2006.01)

(52) U.S. Cl. ..... 401/48; 401/131; 401/118; 248/139

(58) Field of Classification Search ..... 401/48, 401/131, 118, 126–130; 248/139, 137, 140–142, 248/133, 127, 128, 136, 148, 291.1, 184.1, 248/176.3, 284.1
See application file for complete search history.

(56) References Cited

U.S. PATENT DOCUMENTS 2,161,347 A * 6/1939 Griffin ..... 248/137
4,321,935 A * 3/1982 Sussman ..... 132/73
5,772,163 A * 6/1998 Young ..... 248/139
6,685,147 B1 * 2/2004 Ma ..... 248/139

* cited by examiner

*Primary Examiner* — David J. Walczak
*Assistant Examiner* — Keegan Gumbs

(57) ABSTRACT

A nail polish bottle holder device for adjustably supporting and tilting a bottle of nail polish providing a non-slip base having an outside edge and a pivotable stand permanently attached near the outside edge. The stand has a hollow cylindrical pivotal attachment pivotally attached thereto, an extender arm extending inside the pivotal attachment, and a holding ring pivotally attached to the extender arm. The substantially toroid-shaped holding ring has a flat non-slip internal wall. The internal wall, as well as the base, may be formed from cork, rubber, or high-density foam.

6 Claims, 3 Drawing Sheets

NAIL POLISH BOTTLE DEVICE

BACKGROUND OF THE INVENTION

Various nail polish bottle holding devices have been developed in the past for supporting a nail polish bottle while painting an individual's nails. However, what is needed is a nail polish bottle holder device for adjustably supporting and tilting a bottle of nail polish providing a non-slip base having an outside edge. A pivotable stand is permanently attached near the outside edge. The stand has a hollow cylindrical pivotal attachment pivotally attached thereto, an extender arm extending inside the pivotal attachment, and a holding ring pivotally attached to the extender arm. The holding ring has a flat non-slip internal wall. The base and the ring internal wall may be formed from cork, rubber or high-density foam.

SUMMARY OF THE INVENTION

The present nail polish bottle holder device is used in combination with a bottle of nail polish. The device provides a non-slip base and a pivotable stand permanently attached to an outside edge of the base. The stand provides a hollow cylindrical pivotal attachment pivotally attached thereto, an extender arm which slidably engages the interior of the pivotal attachment, and a holding ring which pivotally engages the extender arm. Both the base and an internal wall of the holding ring are formed of a non-slip material, including cork, rubber, and high-density foam.

Thus, a person may dip nail polish brush into the nail polish bottle without having to hold onto the bottle simultaneously. The non-slip base and ring interior wall reduce the potential of the nail polish bottle from falling and the polish from spilling. In addition, the nail polish in the bottle becomes easier to reach with the brush due to the tilting of the bottle. The device also relieves the user from having to hold the bottle while simultaneously painting finger nails and from having to alternately set aside a bottle of nail polish and then pick up the bottle to obtain more nail polish on the brush.

As such, the general purpose of the improved nail polish bottle holder device which has all of the advantages of the prior art mentioned heretofore and many novel features that result in an improved nail polish bottle holder device which is not anticipated, rendered obvious, suggested, or even implied by the prior art, either alone or in combination thereof.

Thus has been broadly outlined the more important features of the improved nail polish bottle holder device so that the detailed description thereof that follows may be better understood and in order that the present contribution to the art may be better appreciated.

The objects, features and advantages of the improved nail polish bottle holder device will be readily apparent to those of ordinary skill in the art upon reading the following detailed description of presently preferred, but nonetheless illustrative, embodiments of the improved nail polish bottle holder device when taken in conjunction with the accompanying drawings. In this respect, before explaining the current embodiments of the improved nail polish bottle holder device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and devices for carrying out the several purposes of the improved nail polish bottle holder device. It is therefore important that the claims be regarded as including such equivalent constructions insofar as they do not depart from the spirit and scope of the present invention.

Objects of the improved nail polish bottle holder device, along with various novel features that characterize the invention are particularly pointed out in the claims forming a part of this disclosure. For better understanding of the improved nail polish bottle holder device, its operating advantages and specific objects attained by its uses, refer to the accompanying drawings and description.

DETAILED DESCRIPTION OF THE DRAWINGS

Figure 1:
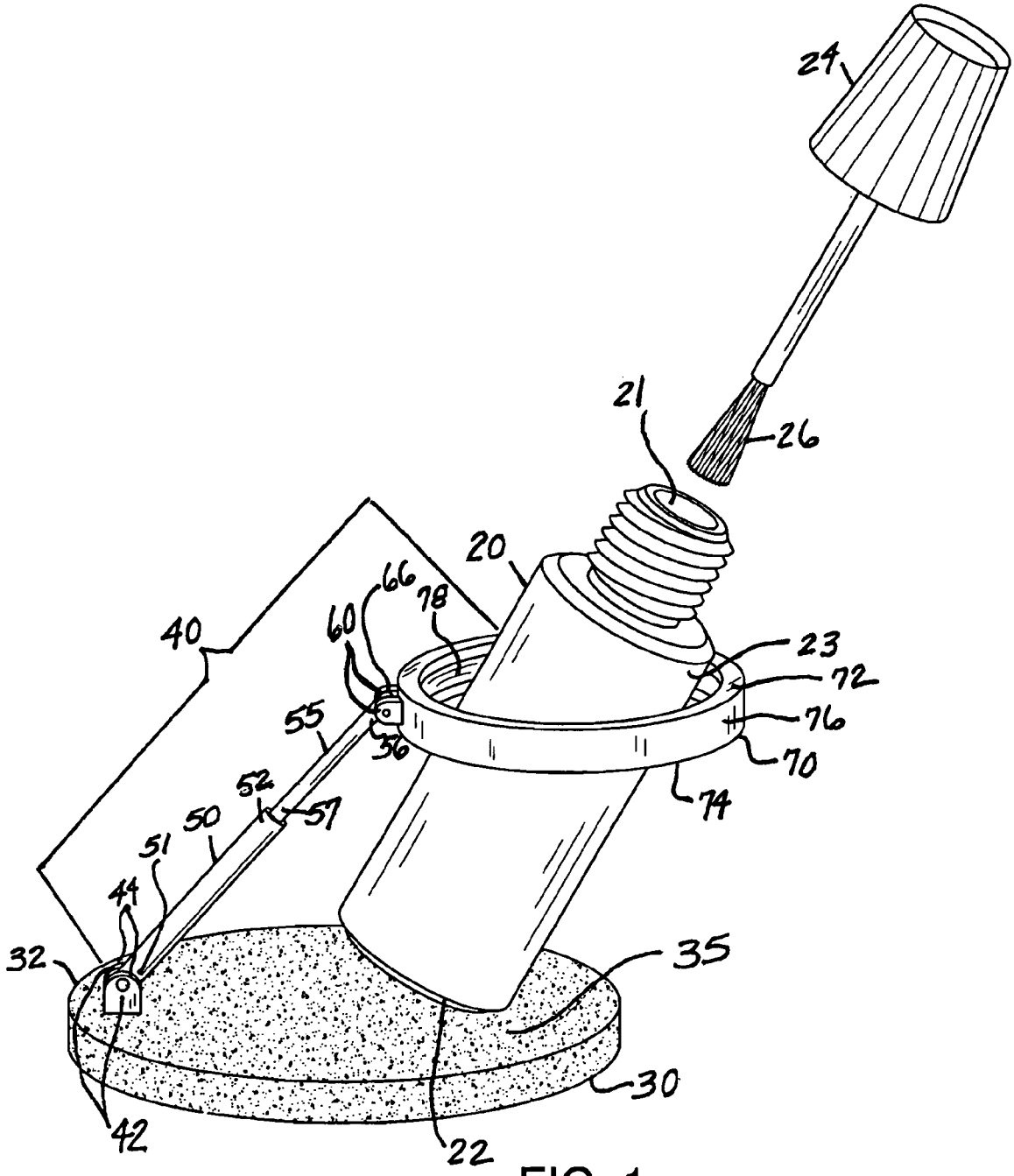
FIG. 1 is an in use side isometric view.
Figure 2:
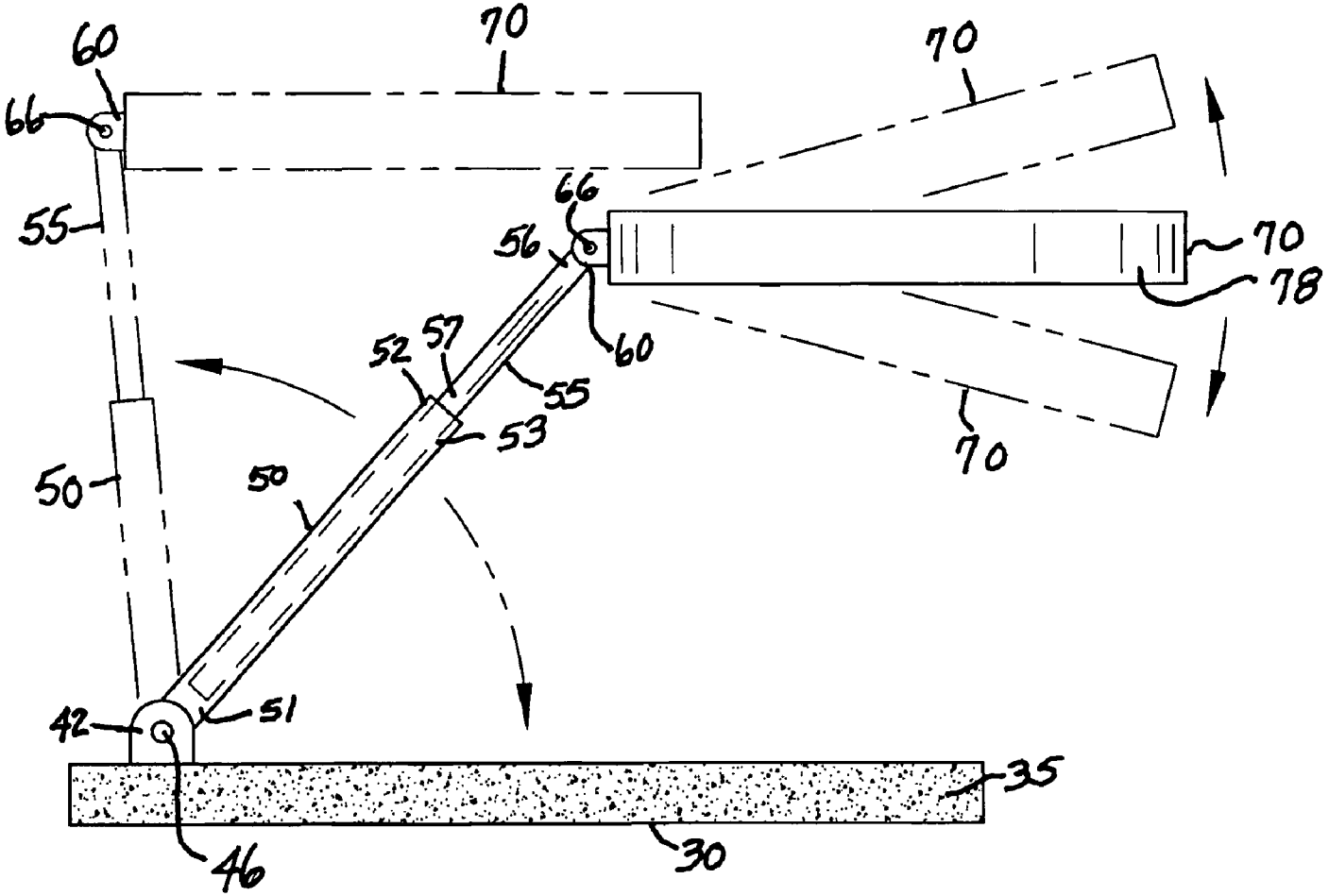
FIG. 2 is a side elevation view illustrating the tilting properties of the present device.
Figure 4:
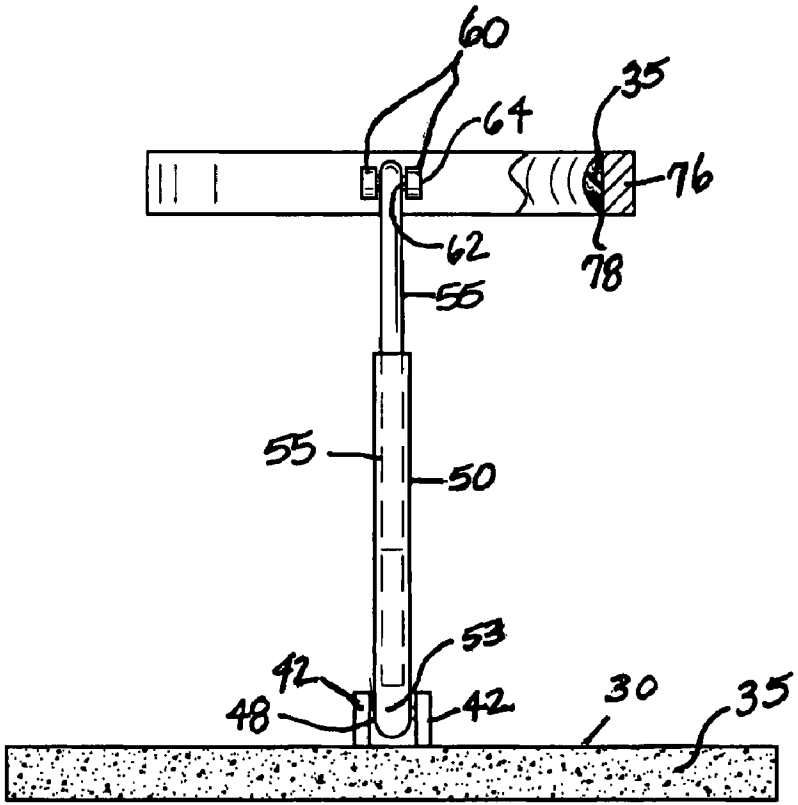
FIG. 4 is a rear elevation view with a partial cutaway.
Figure 3:
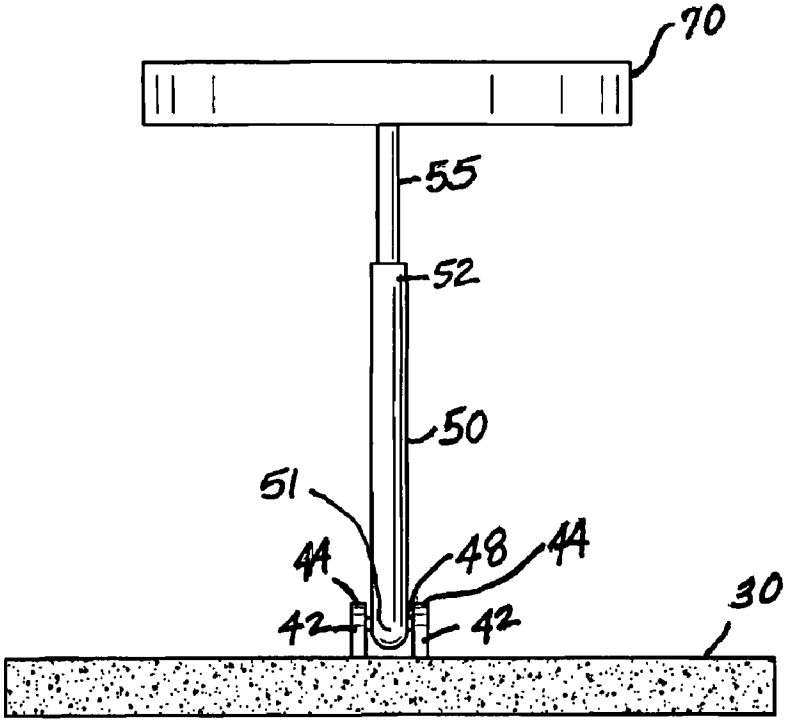
FIG. 3 is a front elevation view.

With reference now to the drawings, and in particular FIGS. 1 through 4 thereof, examples of the employing the principles and concepts of the present nail polish bottle holder device, generally designated by the reference number 10, will be described.

Referring to FIGS. 1 through 4, the present nail polish bottle holder device 10 provides, in combination, a cylindrical bottle of nail polish 20 containing nail polish therein, a non-slip base 30, and a stand 40. The bottle has a bottom portion 22, upper end 23, an upper opening 21 in the upper end 23, and a removable top 24 having a brush 26 integrated therein. The upper opening 21 removably receives the brush 26. The non-slip base 30 has an outside edge, the base 30 formed of a non-slip material 35. The pivotable stand 40 is permanently attached to an outside edge 32 of the base 30. The stand 40 provides a pair of identical quonset-shaped first supports 42, each having a top edge 44. The first supports 42 are in parallel alignment and mounted vertically at a 90-degree angle to the base 30. Each first support 42 has an aperture 46 centered near the top edge 44. A cylindrical first axle 48 runs through each aperture 46 and further runs continuously from one first support 42 to the other first support 42. A hollow cylindrical pivotal attachment 50 is also provided. The pivotal attachment 50 has a bottom end 51, a top end 52, and an interior cavity 53. The bottom end 51 is pivotally attached to the first axle 48. The device 10 further provides a solid extender arm 55 having a lower portion 56 and an upper portion 57. The lower portion 56 slidably engages the interior cavity 53 of the pivotal attachment 50. The upper portion 57 has a pair of identical quonset-shaped second supports 60. The second supports 60 have an internal edge 62 and an external edge 64. The second supports 50 are in parallel alignment. The internal edge 62 of the second supports 60 are fixedly mounted to the extender arm 55. A cylindrical second axle 66 runs continuously from one second support 60 to the other second support 60. A substantially toroid-shaped holding ring 70 having a flat upper edge 72, a flat lower edge 74, a flat external wall 76, and a flat non-slip internal wall 78, the internal wall 78 formed of a non-slip material. A portion of the external wall 76 is pivotally mounted to the external edge 64 of the pivotal attachment 50 second support 60. The base 30 removably receives the bottom portion 22 of the bottle 20 while the holding ring 70 removably receives the bottle 20 upper end 23. The holding ring 70 is pivotally adjusted to change the angle between the pivotal attachment 50 and the base 30, thereby adjustably tilting the bottle 20 in a plurality of angles to the base 30. The non-slip material 35 of the base 30 and the holding ring 70 internal wall 78 may be cork, rubber, or high-density form. The base 30 may be round or may be formed of other shapes.

With respect to the above description then, it is to be realized that the optimum dimensional relationships for the parts of the present device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A nail polish bottle holder device comprising, in combination:

a cylindrical bottle of nail polish containing nail polish therein, the bottle having a bottom portion, upper end, an opening in the upper end, and a removable top having a brush integrated therein, wherein the upper opening removably receives the brush;

a non-slip base having an outside edge, the base formed of a non-slip material;

a pivotable stand permanently attached to the base near the outside edge, the stand comprising:

a pair of identical quonset-shaped first supports, each having a top edge, the first supports in parallel alignment and mounted vertically at a 90-degree angle to the base, each first support having an aperture centered near the top edge;

a cylindrical first axle running through each aperture and running continuously from one first support to the other first support;

a hollow cylindrical pivotal attachment having a bottom end, a top end, and an interior cavity, the bottom end pivotally attached to the first axle;

a solid extender arm having a lower portion and an upper portion, the lower portion slidably engaging the interior cavity of the pivotal attachment and the upper portion having a pair of identical quonset-shaped second supports having an internal edge and an external edge, the second supports in parallel alignment, the internal edge fixedly mounted to the extender;

a cylindrical second axle running continuously from one second support to the other second support;

a substantially toroid-shaped holding ring having a flat upper edge, a flat lower edge, a flat external wall, and a flat non-slip internal wall formed of a non-slip material, a portion of the external wall pivotally mounted to the external edge of the pivotal attachment second support;

wherein the base removably receives the bottom portion of the bottle;

wherein the holding ring removably receives the bottle upper end; and further wherein the holding ring is pivotally adjusted to change the angle between the pivotal attachment and the base, thereby adjustably tilting the bottle in a plurality of angles to the base.

2. The device of claim 1 wherein the non-slip material is cork.

3. The device of claim 1 wherein the base is round.

4. The device of claim 1 wherein the non-slip material is rubber.

5. The device of claim 3 wherein the non-slip material is cork.

6. The device of claim 3 wherein the non-slip material is rubber.

* * * * *